United States Patent [19]

Grothe et al.

[11] Patent Number: 4,705,094

[45] Date of Patent: Nov. 10, 1987

[54] DISTANCING MEANS FOR DUMMY BARS IN CONTINUOUS CASTING APPARATUS

[75] Inventors: Horst Grothe, Kaarst; Gerhard Arnolds, Mulheim-Ruhr, both of Fed. Rep. of Germany

[73] Assignee: SMS Concast Inc., Montvale, N.J.

[21] Appl. No.: 888,142

[22] Filed: Jul. 18, 1986

[30] Foreign Application Priority Data

Jul. 20, 1985 [DE] Fed. Rep. of Germany ..... 3525969

[51] Int. Cl.[4] ..... B22D 11/08

[52] U.S. Cl. ..... 164/426; 164/446

[58] Field of Search ..... 164/425, 426, 445, 446, 164/483

[56] References Cited

FOREIGN PATENT DOCUMENTS

| | | | |
|---|---|---|---|
| 2557301 | 6/1977 | Fed. Rep. of Germany | 164/445 |
| 56-80942 | 6/1981 | Japan . | |
| 57-92450 | 6/1982 | Japan . | |
| 57-209755 | 12/1982 | Japan | 164/446 |
| 57-195565 | 12/1982 | Japan | 164/426 |
| 58-184045 | 10/1983 | Japan | 164/426 |

*Primary Examiner*—Nicholas P. Godici

*Assistant Examiner*—Richard K. Seidel

*Attorney, Agent, or Firm*—Peter K. Kontler; Tobias Lewenstein

[57] ABSTRACT

A continuous casting apparatus has a casting platform which supports a mold defining two casting passages. A laterally undivided roller guide is disposed below the mold. The apparatus further includes a pair of dummy bars, and a carriage on the casting platform for storing the dummy bars. When a casting operation is to be performed, each dummy bar is lowered into the roller guide via a respective casting passage so as to seal the lower end of such passage. At this time, the dummy bars are spaced from, and are generally parallel to, one another. Since the roller guide is laterally undivided, the roller guide is unable to maintain the spacing between the dummy bars as the latter are withdrawn from the roller guide during casting. Accordingly, distancing means is provided to keep the dummy bars spaced from one another. The distancing means includes a rod-like member which is receivable by one of the dummy bars in such a manner as to extend laterally of the dummy bars across at least a portion of the gap between the same.

19 Claims, 5 Drawing Figures

DISTANCING MEANS FOR DUMMY BARS IN CONTINUOUS CASTING APPARATUS

BACKGROUND OF THE INVENTION

The invention relates generally to a continuous casting apparatus, e.g., an apparatus for the continuous casting of steel.

More particularly, the invention relates to means for distancing neighboring dummy bars while the latter are engaged in strand withdrawal.

A known continuous casting apparatus is designed to permit the casting of a single large slab or, alternatively, of two or more smaller strands simultaneously. The apparatus includes a plurality of dummy bars as well as a laterally undivided roller guide for the strand or strands.

When the apparatus is to cast a plurality of strands simultaneously, continuous casting mold means defining a corresponding plurality of casting passages is positioned above the strand guide. For each strand, a dummy bar is introduced into the strand guide from above by lowering the dummy bar through the respective casting passage. The dummy bars are lowered until the heads of the dummy bars are received by the corresponding casting passages and close the passages from below. The dummy bars are now disposed side-by-side in the strand guide and are generally parallel to one another.

Since the strand guide is laterally undivided, the dummy bars can shift laterally during strand withdrawal, e.g., due to bending of the guide rollers, so that the dummy bars are no longer parallel to one another. In order to avoid such shifting, distancing means must be provided to maintain a constant distance between neighboring dummy bars.

A known distancing arrangement consists of two hooks recessed into those sides of two dummy bars which face one another. After the dummy bars have been passed through the casting passages, the hooks are pivoted outwards and locked to one another. Such a distancing arrangement is disclosed in the Japanese Utility Model No. 56-80 942.

Another known distancing arrangement consists of two locking bars which are pivotally mounted in recesses of a central dummy bar. The locking bars pivot laterally out of the recesses in response to pressure exerted by a plunger connected with a toggle joint. The locking bars enter perpendicular recesses in neighboring dummy bars and are held there by means of latches. A distancing arrangement of this type is disclosed in the Japanese Utility Model No. 57-92 450.

The known distancing arrangements have certain drawbacks. Thus, they are expensive and neither sufficiently sturdy nor sufficiently reliable.

OBJECTS AND SUMMARY OF THE INVENTION

It is an object of the invention to provide a more reliable distancing arrangement for dummy bars.

Another object of the invention is to provide a dummy bar distancing arrangement which is relatively easy to manipulate.

The preceding objects, as well as others which will become apparent as the description proceeds, are achieved by the invention.

One aspect of the invention resides in a continuous casting apparatus, particularly for the continuous casting of metals, e.g., steel. The apparatus comprises a pair of dummy bars each of which is movable to a respective predetermined position preparatory to initiating strand withdrawal. The dummy bars are disposed side-by-side and define a gap when they are in the predetermined positions simultaneously. The apparatus further comprises means for distancing the dummy bars from one another. The distancing means includes a rod-like member receivable by one of the dummy bars in such a manner as to extend transversely of such dummy bar and across at least a portion of the gap.

The distancing means of the invention can be manufactured relatively economically, and is relatively sturdy and reliable in operation.

The apparatus may include a casting platform on which the dummy bars may be stored when not in use. The casting platform may also function to support continuous casting mold means defining one or more casting passages. A roller guide for the strand or strands may be located below the mold means, and the roller guide may be laterally undivided or continuous. The apparatus may further include means for lowering the dummy bars into the roller guide through the casting passages in order to position the dummy bars in readiness for casting.

According to one embodiment of the invention, one of the dummy bars is provided with a double-acting piston-and-cylinder unit. The piston-and-cylinder unit is in communication with a pair of conduits for pressurized fluid, e.g., hydraulic fluid, and a check valve is provided for each conduit. The piston-and-cylinder unit includes a piston rod, and the latter at least partly constitutes the rod-like member of the distancing means. The piston rod has an end face which is arranged to confront and contact a lateral surface of a neighboring dummy bar.

The conduits for the pressurized fluid may be disposed in and extend along the dummy bar having the piston-and-cylinder unit. A source of hydraulic fluid may be located on the casting platform, and the source may include quick-disconnect couplings for connecting the conduits with the source. The apparatus may comprise a carriage which is movably mounted on the casting platform and supports the dummy bars during storage, and the hydraulic fluid source may be situated on the carriage.

In accordance with another embodiment of the invention, the rod-like member is provided with ribs for maintaining two neighboring dummy bars at a predetermined distance from one another. Each of the dummy bars is provided with an opening designed to receive the rod-like member, and the openings are arranged to be in register with one another when the dummy bars are properly positioned in the strand guide preparatory to initiating strand withdrawal. The rod-like member is inserted in the registering openings and is thereafter rotatable to a position in which the ribs lock the dummy bars together so that the dummy bars are unable to move towards or away from each other. The apparatus may be provided with a device which is located laterally of the strand guide rollers and functions to insert the rod-like member in the registering openings and to rotate the rod-like member to the locked position. The device comprises an elongated rotatable guide having a passage, and a holder for the rod-like member mounted in the passage for movement longitudinally of the guide.

The device for manipulating the rod-like member may further comprise means for moving the holder along the guide. The moving means may include a worm device or a rack-and-pinion drive.

The dummy bars move along respective paths as strand withdrawal is initiated, and the apparatus may be provided with an abutment which is movable into such paths from a position laterally of the strand guide rollers. The abutment may serve to properly position the dummy bars in readiness for strand withdrawal.

The novel features which are considered as characteristic of the invention are set forth in particular in the appended claims. The improved continuous casting apparatus itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
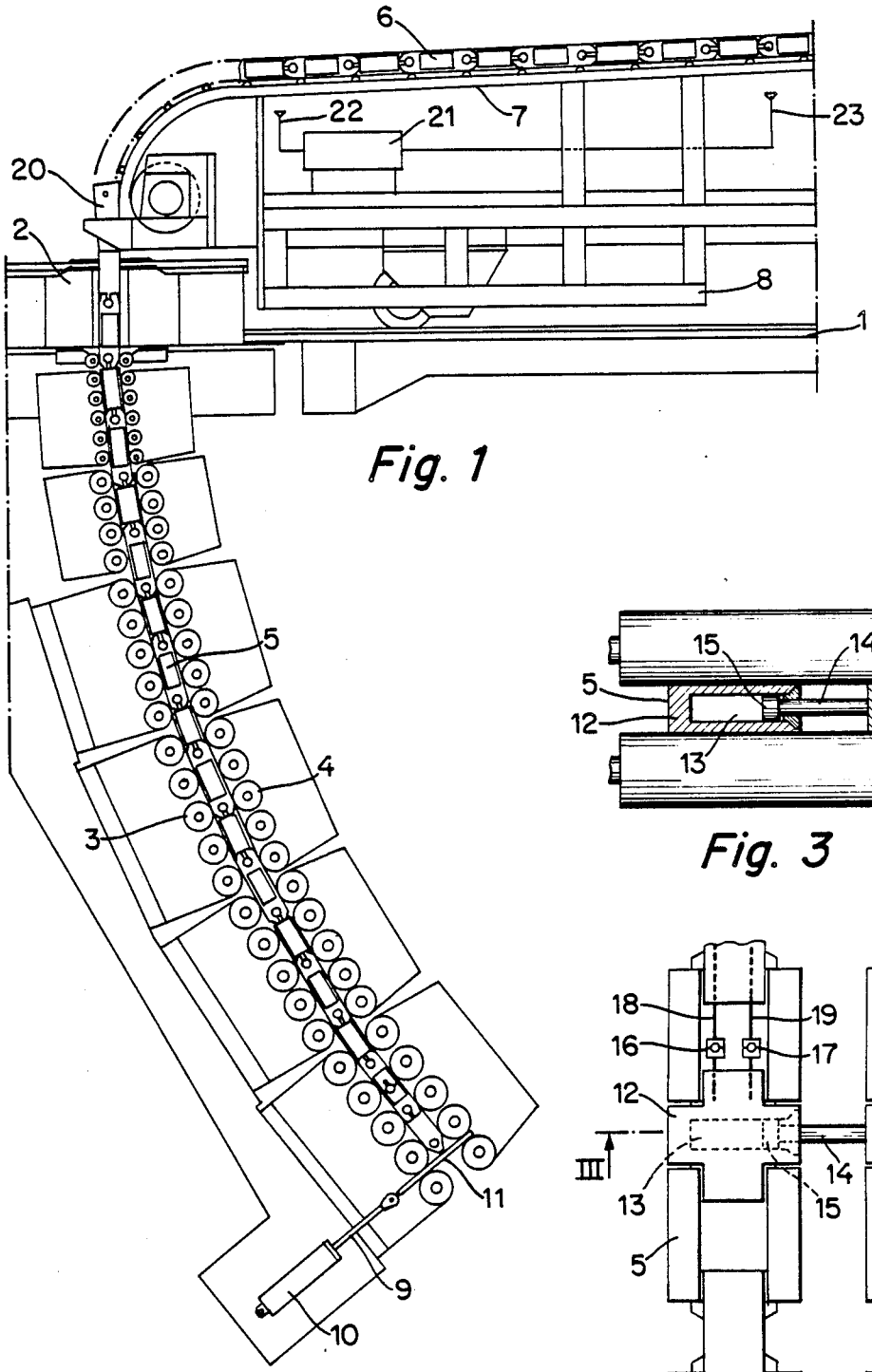
FIG. 1 is a fragmentary elevational view of a continuous casting apparatus according to the invention.

FIG. 1 shows a continuous casting apparatus which is particularly well-suited for the continuous casting of metals, e.g., steel. The apparatus is designed so as to be capable of casting a single large slab or, alternatively, two or more smaller strands simultaneously. The apparatus includes a casting platform 1 which carries continuous casting mold means 2. It is assumed here that the apparatus is set up for the simultaneous casting of two strands and, to this end, the mold means 2 defines two casting passages. The mold means 2 may be constituted by a double mold, that is, a mold having a casting passage which is divided into two parts by a partition.

A curved strand guide is disposed below, i.e., downstream of, the mold 2 and includes a row of roller pairs 3,4. The rollers 3,4, which constitute support and guide rollers, define a predetermined path for the strands formed in the mold 2. The strand guide 3,4 is laterally undivided or continuous, that is, the strand guide 3,4 is not partitioned laterally.

A carriage 8 is mounted on the casting platform 1 for movement towards and away from the mold 2. The carriage 8 has a support 7 which is designed to carry two discrete dummy bars 5 and 6 for storage. One of the dummy bars 5,6 is employed for each of the two individual strands to be cast in the mold 2.

When the dummy bars 5,6 are to be used, the carriage 8 is moved to a position in the vicinity of the mold 2 as shown. The dummy bars 5,6 are then lowered from the carriage 8 through the respective casting passages of the mold 2 and into the strand guide 3,4 via the upper end of the latter. The carriage 8 may be considered to constitute, or constitute part of, a means for admitting the dummy bars 5,6 into the strand guide 3,4.

A piston-and-cylinder unit 10 is disposed to one side of the strand guide rollers 3,4 and includes a piston rod 9. An abutment 11 is mounted on the free end of the piston rod 9. The piston-and-cylinder unit 9,10 is arranged to shift the abutment 11 between an inoperative position to the side of the strand guide rollers 3, 4, and the illustrated operative position in which the abutment 11 projects into the strand guide 3,4, and hence into the paths of the dummy bars 5,6 and the respective strands. In the operative position, the abutment 11 is situated between two neighboring pairs of rollers 3,4. The abutment 11 is shifted to the operative position when the dummy bars 5,6 are lowered into the strand guide 3,4. The abutment 11 serves to arrest the dummy bars 5,6 in a preselected relative position such that the dummy bars 5,6 are disposed side-by-side and are similarly situated.

Figure 3:
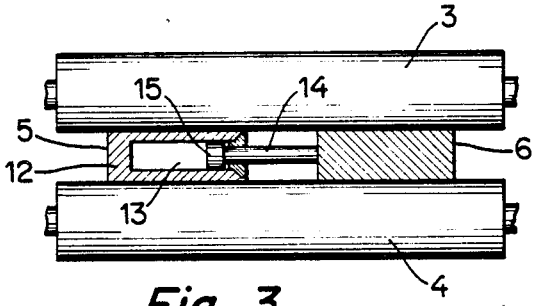
FIG. 3 is a sectional view of the dummy bars of FIG. 2 as seen in the direction of the arrows III—III but shows the dummy bars in a strand guide constituting part of the apparatus of FIG. 1.
Figure 2:
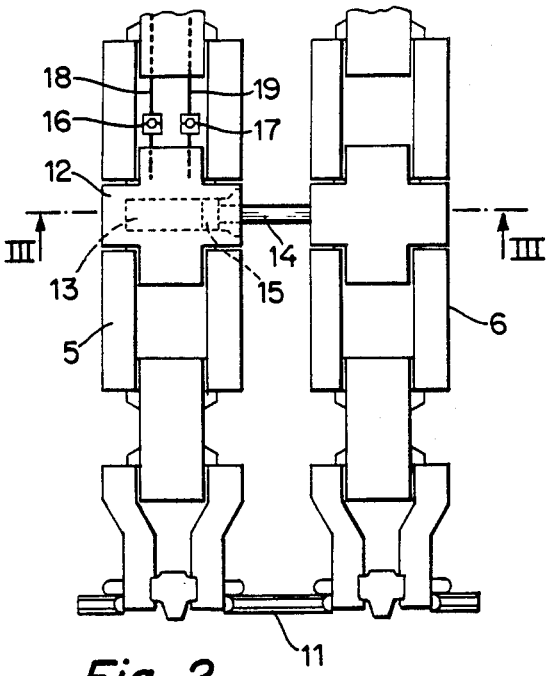
FIG. 2 is a fragmentary plan view of two dummy bars constituting part of the apparatus of FIG. 1 and shows one embodiment of a distancing means in accordance with the invention.

As shown in FIGS. 2 and 3, the dummy bars 5,6 are spaced from, and extend generally parallel to, one another in the relative position established by the abutment 11. Since the strand guide 3,4 is laterally undivided, the strand guide 3,4 cannot prevent the dummy bars 5,6 from shifting laterally towards and away from one another as the dummy bars 5,6 are drawn out of the strand guide 3,4 during a casting operation. In order to prevent the dummy bars 5,6 from coming into contact with one another, a distancing means is accordingly provided to maintain a spacing between the dummy bars 5,6.

Each of the dummy bars 5,6 is composed of a series of links which are articulated to one another. One such link of the dummy bar 5 is identified by the reference numeral 12. The distancing means comprises a double-acting, hydraulic piston-and-cylinder unit which is disposed in the link 12. The piston-and-cylinder unit of the distancing means includes a cylinder 13 in the link 12, and a piston 15 which rides in the cylinder 13. A rod-like member 14 constituting a piston rod is mounted on the piston 15. The piston rod 14 is retractable into the cylinder 13, and the piston rod 14 is maintained in the retracted position while the dummy bars 5, 6 are lowered from the carriage 8 to the relative position established by the abutment 11. Once the dummy bars 5,6 are in such relative position, the piston rod 14 is moved to the extended position shown in FIGS. 2 and 3. In the extended position, the piston rod 14 bridges at least a portion of the gap between the dummy bars 5,6. The piston rod 14 extends transversely of the dummy bars 5,6 and the free end face of the piston rod 14 is arranged to contact that side or lateral surface of the dummy bar 6 which faces the dummy bar 5.

Each of the dummy bars 5,6 has a dummy bar head 20 which functions to close the lower end of the respective casting passage in the mold 2 preparatory to the start of a cast and initiation of strand withdrawal. The link 12 of the dummy bar 5 is formed with a pair of channels which communicate with the cylinder 13 of the distancing means. The channels are connected with respective lines or conduits 18, 19 for pressurized hydraulic fluid via respective check valves 16, 17. The hydraulic lines 18, 19 are disposed in the dummy bar 5 and extend from the link 12 to the region of the corresponding dummy bar head 20.

A source 21 of pressurized hydraulic fluid is mounted on the carriage 8 which serves to store the dummy bars 5,6. The source 21 includes a pair of quick-disconnect couplings 22,23 by means of which the respective hydraulic lines 18,19 can be connected with the source.

The dummy bars 5,6 are arrested by the abutment 11 in such positions that at least a portion of each dummy bar head 20 is located above the mold 2. Since the hydraulic lines 18,19 extend to the region of the dummy bar head 20 of the dummy bar 5, the hydraulic lines 18,19 are accessible to the quick-disconnect couplings 22,23 when the dummy bar 5 is arrested by the abutment 11. This allows the piston rod 14 to be moved to the extended position from the casting platform 1 after the distancing means 13–15 has passed through the mold 2.

The operation is as follows:

It is assumed that the dummy bars 5,6 are initially on the carriage 8 and that the piston rod 14 is in its retracted position. The carriage 8 is moved to the vicinity of the mold 2 and positioned in readiness to unload the dummy bars 5,6. The abutment 11 is shifted to the operative position in which it projects into the paths of the dummy bars 5,6.

The dummy bars 5,6 are lowered from the carriage 8 through the respective casting passages of the mold 2 and into the strand guide 3,4. Lowering of the dummy bars 5,6 is continued until the latter are arrested by the abutment 11. At this time, the distancing means 13–15 has passed through the respective casting passage and is located in the strand guide 3,4.

The hydraulic lines 18,19 are connected with the quick-disconnect couplings 22,23. Pressurized hydraulic fluid is fed to the cylinder 13 of the distancing means 13–15 so as to cause the piston 15 to move the piston rod 14 to its extended position. Once the piston rod 14 is in its extended position, the quick-disconnect couplings 22,23 are released from the hydraulic lines 18,19. Due to the check valves 16,17 associated with the hydraulic lines 18,19, the piston 15 is able to retain the piston rod 14 in the extended position even though the hydraulic lines 18,19 have been disconnected from the hydraulic fluid source 21-23. The piston rod 14 is thus able to provide a continuous distancing action as the dummy bars 5,6 are drawn through the strand guide 3,4.

After the piston rod 14 has been moved to its extended position, the abutment 11 is shifted to its inoperative position laterally of the strand guide rollers 3,4. The dummy bars 5,6 are then lowered further until the dummy bar heads 20 close the lower ends of the casting passages of the mold 2. The dummy bars 5,6 now occupy predetermined positions preparatory to the start of a cast and initiation of strand withdrawal.

Casting proceeds in a conventional manner, and the dummy bars 5,6 are drawn out of the strand guide 3,4 through the lower end thereof to initiate strand withdrawal. Once the dummy bars 5,6 have left the strand guide 3,4, the dummy bars 5,6 are disconnected from the respective strands and returned to the casting platform 1 for storage. The carriage 8 is moved away from the mold 2 to a position in which it can receive the dummy bars 5,6 as the latter are lifted back to the casting platform 1.

When the dummy bars 5,6 have been redeposited on the carriage 8, the hydraulic lines 18,19 are again connected with the quick-disconnect couplings 22,23. Pressurized hydraulic fluid is then fed to the cylinder 13 of the distancing means 13–15 so as to cause the piston 15 to move the piston rod 14 to its retracted position. The dummy bars 5,6 are now ready to be lowered through the respective casting passages of the mold 2 once more.

If more than two strands are to be cast, one or more additional dummy bars will be provided. Two or more dummy bars may then be equipped with the distancing means 13–15.

Figure 4:
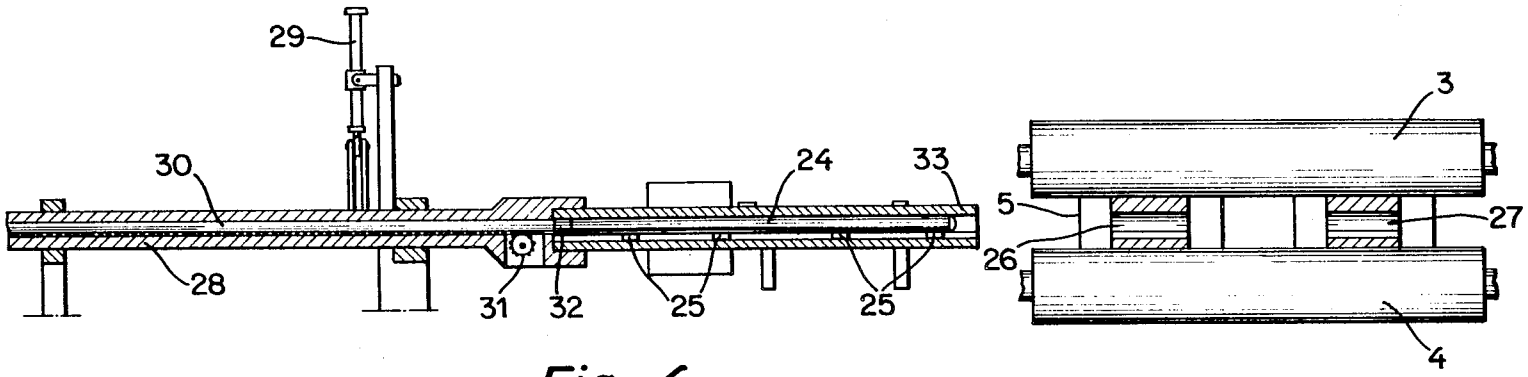
FIG. 4 is similar to FIG. 3 but illustrates two dummy bars designed for another embodiment of the distancing means according to the invention.
Figure 5:
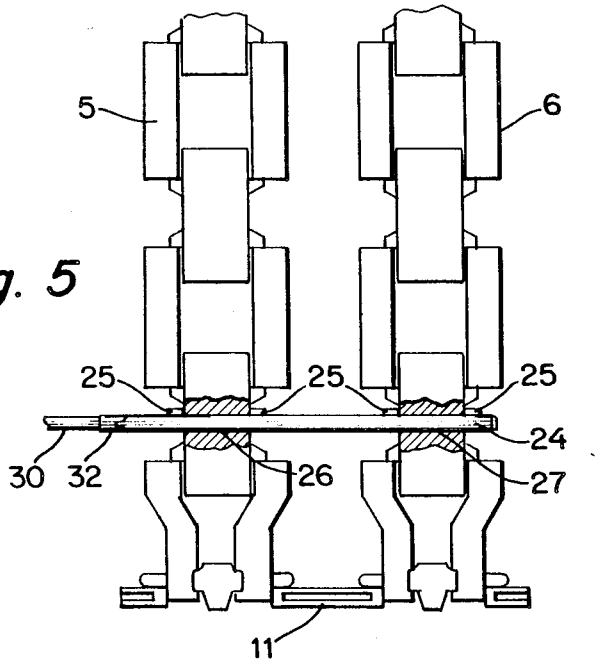
FIG. 5 is a fragmentary partly sectional plan view of the dummy bars of FIG. 4.

FIGS. 4 and 5 illustrate another embodiment of the distancing means. The same reference numerals as in FIGS. 1–3 are used to identify like elements.

In FIGS. 4 and 5, the distancing means comprises a rod-like member or rod 24. The rod 24 is provided with four spaced ribs 25 which function to establish a predetermined spacing between the dummy bars 5,6.

The dummy bar 5 is formed with a transverse opening 26 while the dummy bar 6 is formed with a similar transverse opening 27. The openings 26,27 are arranged to be in register with one another when the dummy bars 5,6 are arrested by the abutment 11. The openings 26,27 are designed to receive the rod 24, and each of the openings 26,27 is provided with a groove which can receive the ribs 25. The rod 24 can be passed through the openings 26,27 when the ribs 25 are aligned with the grooves but is prevented from passing through the openings 26,27 when the ribs 25 are out of alignment with the grooves.

As illustrated in FIG. 5, the rod 24 can be inserted in the openings 26,27 sudh that two of the ribs 25 flank the dummy bar 5 and two of the ribs 25 flank the dummy bar 6. If the rod 24 is now rotated so that the ribs 25 are moved out of alignment with the grooves in the openings 26,27, the dummy bars 5,6 are locked to, and held at a predetermined distance from, one another. This is due to the ribs 25 which prevent relative movement of the dummy bars 5,6 longitudinally of the rod 24. The dummy bars 5,6 may be disengaged from each other by rotating the rod 24 to a position in which the ribs 25 are again aligned with the grooves in the openings 26,27. The position of the rod 24 in which the ribs 25 are out of alignment with the grooves may be considered to be a first or locked position of the rod 24 while the position of the rod 24 in which the ribs 25 are aligned with the grooves may be considered to be a second or released position of the rod 24. In the locked position, the rod 24 extends transversely of, and bridges the gap between, the dummy bars 5,6.

Referring to FIG. 4, a device for inserting and rotating the rod 24 in the openings 26,27 is disposed laterally of the strand guide rollers 3,4. The device includes a guide having an elongated first portion 28 which is rotatably supported by bearings. A piston-and-cylinder unit 29 is coupled to the first guide portion 28 and functions to rotate the latter. The first guide portion 28 is provided with a longitudinal passage, and an elongated toothed rack 30 is mounted in this passage for rotation with the first guide portion 28. The toothed rack 30 is in mesh with a pinion 31 which is driven by a non-illustrated reversible drive mechanism and serves to move the rack 30 longitudinally of the passage in the first guide portion 28.

The guide constituting part of the device for inserting and rotating the rod 24 in the openings 26,27 further has an elongated second portion 33 which is received by the first guide portion 28. The second guide portion 33, which extends from the first guide portion 28 to a location adjacent to the strand guide rollers 3,4, has a longitudinal passage which registers with the passage in the first guide portion 28. The passage in the second guide portion 33 is arranged to register with the openings 26,27 in the dummy bars 5,6 when the latter are arrested by the abutment 11.

The second guide portion 33 is designed to accommodate the rod 24 preparatory to insertion of the rod 24 in the openings 26,27. A holder 32 for the rod 24 is mounted at the end of the rack 30 nearest the second guide portion 33, and the rack 30 is arranged to move the holder 32 longitudinally of the passage in the second guide portion 33.

The operation of a continuous casting apparatus designed in accordance with FIGS. 4 and 5 is as follows:

It is assumed that the dummy bars 5,6 are initially on the carriage 8 and that the rod 24 is held inside the second guide portion 33 by the holder 32. The carriage 8 is moved to the vicinity of the mold 2 and positioned in readiness to unload the dummy bars 5,6. The abutment 11 is shifted to the operative position in which it projects into the paths of the dummy bars 5,6.

The dummy bars 5,6 are lowered from the carriage 8 through the respective casting passages of the mold 2 and into the strand guide 3,4. Lowering of the dummy bars 5,6 is continued until the latter are arrested by the abutment 11. At this time, the openings 26,27 in the dummy bars 5,6 are in register with the passage in the second guide portion 33.

For the embodiment of the distancing means shown in FIGS. 2 and 3, the position of the abutment 11 along the strand guide 3,4 is selected in such a manner that at least a portion of each dummy bar head 20 is located above the mold 2 when the dummy bars 5,6 contact the abutment 11. This is necessary in order for the hydraulic lines 18,19 to be accessible for connection with the quick-disconnect couplings 22,23. Since this requirement does not apply for the embodiment of the distancing means illustrated in FIGS. 4 and 5, the abutment 11 may be positioned so that the dummy bar heads 20 close the lower ends of the casting passages of the mold 2 when the dummy bars 5,6 are arrested by the abutment 11. The abutment 11 then functions to arrest the dummy bars 5,6 in requisite position for the start of a cast and initiation of strand withdrawal.

Once the dummy bars 5,6 have been arrested by the abutment 11 and the openings 26,27 are in register with the passage in the second guide portion 33, the drive for the pinion 31 is activated so that the pinion 31 causes the rack 30 to advance towards the strand guide rollers 3,4. Consequently, the holder 32 advances the rod 24 towards the openings 26,27. The rod 24 is positioned such that the ribs 25 are aligned with the grooves in the openings 26,27 and, as a result, the rod 24 is able to enter the openings 26,27. The rack 30 continues to advance the rod 24 until the latter reaches the position of FIG. 5 in which two of the ribs 25 flank the dummy bar 5 and two of the ribs 25 flank the dummy bar 6. When the rod 24 reaches this position, movement of the rack 30 is discontinued and the piston-and-cylinder unit 29 is activated to rotate the first guide portion 28. Since the rack 30 and the holder 32 are rotatable with the first guide portion 28, activation of the piston-and-cylinder unit 29 causes rotation of the rod 24 so that the ribs 25 are moved out of alignment with the grooves in the openings 26,27. The rod 24 and its ribs 25 then lock the dummy bars 5,6 to one another and maintain the dummy bars 5,6 at a constant distance from each other. The drive for the pinion 31 is now reversed to retract the rack 30 so that the holder 32 becomes disengaged from the rod 24.

After the rod 24 has been locked in the openings 26, 27, the abutment 11 is shifted to its inoperative position laterally of the strand guide rollers 3,4. Casting is begun and proceeds in a conventional manner with the dummy bars 5,6 being drawn out of the strand guide 3,4 via the lower end thereof to initiate strand withdrawal. Once the dummy bars 5,6 have left the strand guide 3,4, the dummy bars 5,6 are disconnected from the respective strands and returned to the casting platform 1 for storage. The carriage 8 is moved away from the mold 2 to a position in which it can receive the dummy bars 5,6 as the latter are lifted back to the casting platform 1.

When the dummy bars 5,6 have been redeposited on the carriage 8, the rod 24 is removed from the openings 26,27. The dummy bars 5,6 are now ready to be lowered through the respective casting passages of the mold 2 once more.

The rod 24 may be used to lock more than two dummy bars to one another by lengthening the rod 24 and providing the latter with additional ribs 25. Furthermore, the rack-and-pinion drive mechanism 30,31 may be replaced by another drive mechanism such as a worm drive.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A continuous casting apparatus, comprising a pair of dummy bars each of which is movable to a respective predetermined position preparatory to initiating strand withdrawal, said dummy bars being disposed side-by-side and defining a gap when said dummy bars are in said positions simultaneously; and means for distancing said dummy bars from one another, said distancing means including a rod-like member receivable by one of said dummy bars in such a manner as to extend transversely of said one dummy bar across at least a portion of said gap, and said distancing means comprising a piston-and-cylinder unit in said one dummy bar, said piston-and-cylinder unit including a piston rod which at least in part constitutes said rod-like member.

2. The apparatus of claim 1, comprising strand guide means having an upper open end, and means for admitting said dummy bars into said strand guide means through said upper open end.

3. The apparatus of claim 1, wherein the other of said dummy bars has a lateral surface which faces said one dummy bar when said dummy bars are in said predetermined positions, said piston rod having an end face arranged to contact said lateral surface.

4. The apparatus of claim 1, wherein said piston-and-cylinder unit is a double-acting unit; and further comprising a pair of conduits for pressurized fluid arranged to communicate with said piston-and-cylinder unit, and a check valve for each of said conduits.

5. The apparatus of claim 4, wherein said conduits are disposed in said one dummy bar.

6. The apparatus of claim 5, comprising a casting platform, and a source of hydraulic fluid on said casting platform, said source including quick-disconnect couplings for connecting said conduits with said source.

7. The apparatus of claim 6, comprising a movable carriage on said casting platform for supporting said dummy bars, said source being mounted on said carriage.

8. The apparatus of claim 1, wherein said dummy bars are movable along respective predetermined paths during initiation of strand withdrawal; and further comprising an abutment shiftable into said paths to arrest said dummy bars in a preselected relative position.

9. A continuous casting apparatus, comprising a pair of dummy bars each of which is movable to a respective predetermined postion preparatory to initiating strand withdrawal, said dummy bars being disposed side-by-side and defining a gap when said dummy bars are in said positions simultaneously; means for distancing said dummy bars from one another, said distancing means including a rod-like member receivable by one of said dummy bars in such a manner as to extend trasversely of said one dummy bar across said gap, and said rod-like member being provided with ribs for establishing a predetermined spacing between said dummy bars, each of said dummy bars having an opening designed to receive said rod-like member, and said openings being arranged to register with one another when said dummy bars are in said predetermined positions, said rod-like member being rotatable in said openings between a first position in which said dummy bars are locked to one another, and a second position in which said dummy bars are disengaged from one another; strand guide means; and means for inserting said rod-like member in said openings and rotating said rod-like member to said first position, said inserting and rotating means being disposed laterally of said strand guide means.

10. A continuous casting apparatus, comprising a pair of dummy bars each of which is movable to a respective predetermined position preparatory to initiating strand withdrawal, said dummy bars being disposed side-by-side and defining a gap when said dummy bars are in said positions simultaneously; means for distancing said dummy bars from one another, said distancing means including a rod-like member receivable by one of said dummy bars in such a manner as to extend transversely of said one dummy bar across said gap, and said rod-like member being provided with ribs for establishing a predetermined dummy spacing between said dummy bars, each of said dummy bars having an opening designed to receive said rod-like member, and said openings being arranged to register with one another when said dummy bars, are in said predetermined positions, said rod-like member being rotatable in said opening between a first position in which said dummy bars are locked to one another, and a second position in which said dummy bars are disengaged from one another; and means for inserting said rod-like member in said openings and rotating said rod-like member to said first position, said inserting and rotating means comprising an elongated rotatable guide, and a holder for said rod-like member mounted on said guide for movement longitudinally thereof.

11. The apparatus of claim 10, wherein said guide is provided with a passage and said holder is disposed in said passage.

12. The apparatus of claim 10, wherein said inserting and rotating means comprises means for moving said holder longitudinally of said guide.

13. The apparatus of claim 12, wherein said moving means comprises a worm drive.

14. The apparatus of claim 12, wherein said moving means comprises a rack-and-pinion drive.

15. A continuous casting apparatus, comprising a pair of dummy bars each of which is movable to a respective predetermined position preparatory to initiating strand withdrawal, said dummy bars being disposed side-by-side and defining a gap when said dummy bars are in said positions simultaneously, and said dummy bars being movable along respective predetermined paths during initiation of strand withdrawal; strand guide means defining said paths; an abutment shiftable into said paths to arrest said dummy bars in a preselected relative position, said abutment having an operative position in which said abutment projects into said paths, and an inoperative position in which said abutment is disposed laterally of said strand guide means; and means for distancing said dummy bars from one another, said distancing means including a rod-like member receivable by one of said dummy bars in such a manner as to extend transversely of said one dummy bar across at least a portion of said gap.

16. The apparatus of claim 15, wherein said rod-like member is provided with ribs for establishing a predetermined spacing between said dummy bars.

17. The apparatus of claim 16, wherein each of said dummy bars is provided with an opening designed to receive said rod-like member, said openings being arranged to register with one another when said dummy bars are in said predetermined positions.

18. The apparatus of claim 17, wherein said rod-like member is rotatable in said openings between a first position in which said dummy bars are locked to one another, and a second position in which said dummy bars are disengaged from one another.

19. The apparatus of claim 18, comprising means for inserting said rod-like member in said openings and rotating said rod-like member to said first position.

* * * * *